US011133169B2

(12) United States Patent
Jones et al.

(10) Patent No.: US 11,133,169 B2
(45) Date of Patent: Sep. 28, 2021

(54) AMBIENT IONISATION SPOT MEASUREMENT AND VALIDATION

(71) Applicant: MICROMASS UK LIMITED, Wilmslow (GB)

(72) Inventors: Emrys Jones, Manchester (GB); Richard Chapman, Runcorn (GB); Steven Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 218 days.

(21) Appl. No.: 16/306,821

(22) PCT Filed: Jun. 5, 2017

(86) PCT No.: PCT/GB2017/051609
§ 371 (c)(1),
(2) Date: Dec. 3, 2018

(87) PCT Pub. No.: WO2017/208026
PCT Pub. Date: Dec. 7, 2017

(65) Prior Publication Data

US 2019/0198307 A1 Jun. 27, 2019

(30) Foreign Application Priority Data

Jun. 3, 2016 (GB) ..... 1609745

(51) Int. Cl.
*H01J 49/00* (2006.01)
*H01J 49/14* (2006.01)
*H01J 49/16* (2006.01)

(52) U.S. Cl.
CPC ..... *H01J 49/142* (2013.01); *H01J 49/0004* (2013.01); *H01J 49/0009* (2013.01); *H01J 49/0031* (2013.01); *H01J 49/165* (2013.01)

(58) Field of Classification Search
CPC ..... H01J 49/0004; H01J 49/0009; H01J 49/0031; H01J 49/142; H01J 49/145; H01J 49/162; H01J 49/165; G01N 27/624
See application file for complete search history.

(56) References Cited

U.S. PATENT DOCUMENTS

2006/0249671 A1* 11/2006 Karpetsky ..... H01J 49/142 250/288
2008/0006769 A1 1/2008 Staats
(Continued)

FOREIGN PATENT DOCUMENTS

CN 102318035 A 1/2012
JP H1048183 A 2/1998
WO 2002/095362 A2 11/2002

OTHER PUBLICATIONS

International Search Report and Written Opinion for International Application No. PCT/GB2017/051609 dated Oct. 9, 2017, 24 pages.
(Continued)

*Primary Examiner* — Robert H Kim
*Assistant Examiner* — Hsien C Tsai
(74) *Attorney, Agent, or Firm* — Kacvinsky Daisak Bluni PLLC

(57) ABSTRACT

Apparatus is disclosed comprising a first ion source (210) arranged and adapted to emit a spray of charged droplets (211) and a detector or sensor (203) arranged and adapted automatically to detect, sense or determine one or more first parameters or properties of the spray of charged droplets (211) as the spray of charged droplets (211) impacts upon a surface of the detector or sensor 203. The apparatus further comprises a control system (204) arranged and adapted to adjust, correct and/or optimise one or more second parameters or properties of the spray of charged droplets (211) based on the one or more first parameters or properties of the
(Continued)

spray of charged droplets (211) detected, sensed or determined by the detector or sensor (203).

18 Claims, 7 Drawing Sheets

(56) References Cited

U.S. PATENT DOCUMENTS

2008/0156985 A1* 7/2008 Venter ..... H01J 49/165
250/288
2009/0159790 A1 6/2009 Kostiainen et al.

OTHER PUBLICATIONS

Search Report for GB Application No. 1609745.3 dated Nov. 4, 2016, 5 pages.

Campbell, D, I., et al., "Improved Spatial Resolution in the Imaging of Biological Tissue Using Desorption Electrospray Ionization" , Analytical and Bioanalytical Chemistry, Springer, 404(2):389-39816, Jun. 16, 2012.

Wood, M C., et al., "Microscopic Imaging of Glass Surfaces under the Effects of Desorption Electrospray Ionization", Analytical Chemistry, 81(15): 6407-6415, Jul. 9, 2009.

Green, F. M., et al., "Developing Repeatable Measurements for Reliable Analysis of Molecules at Surfaces Using Desorption Electrospray Ionization", Analytical Chemistry, 81(6): 2286-2293, Mar. 15, 2009.

Ifa, D. R., et al., "Development of Capabilities for Imaging Mass Spectrometry Under Ambient Conditions with Desorption Electrospay Ionization (DESI)", International Journal of Mass Spectrometry, 259:8-15, Sep. 18, 2006.

International Preliminary Report on Patentability for International Application No. PCT/GB2017/051609 dated Dec. 4, 2018, 18 pages.

* cited by examiner 612
603
t=t0

601a
601b
612
603
t=t1

601a
601b
612
603
t=t2

AMBIENT IONISATION SPOT MEASUREMENT AND VALIDATION

CROSS-REFERENCE TO RELATED APPLICATIONS

This application is a national phase filing claiming the benefit of and priority to International Patent Application No. PCT/GB2017/051609, filed on Jun. 5, 2017, which claims priority from and the benefit of United Kingdom patent application No. 1609745.3 filed on Jun. 3, 2016. The entire contents of these applications are incorporated herein by reference.

FIELD OF THE INVENTION

The present invention relates generally to the analysis or imaging of a target or sample by ambient ionisation techniques such as desorption electrospray ionisation ("DESI"), methods of analysis, imaging and diagnosis and apparatus for analysing or imaging a target or sample using an ambient ionisation ion source. Various embodiments are contemplated wherein analyte ions generated by an ambient ionisation ion source are then subjected either to: (i) mass analysis by a mass analyser such as a quadrupole mass analyser or a Time of Flight mass analyser; (ii) ion mobility analysis (IMS) and/or differential ion mobility analysis (DMA) and/or Field Asymmetric Ion Mobility Spectrometry (FAIMS) analysis; and/or (iii) a combination of firstly ion mobility analysis (IMS) and/or differential ion mobility analysis (DMA) and/or Field Asymmetric Ion Mobility Spectrometry (FAIMS) analysis followed by secondly mass analysis by a mass analyser such as a quadrupole mass analyser or a Time of Flight mass analyser (or vice versa). Various embodiments also relate to an ion mobility spectrometer and/or mass analyser and a method of ion mobility spectrometry and/or method of mass analysis.

BACKGROUND

A number of different ambient ionisation ion sources are known. Ambient ionisation ion sources are characterised by the ability to generate analyte ions from a native or unmodified target.

For example, desorption electrospray ionisation ("DESI") is an ambient ionisation technique that allows direct and fast analysis of surfaces without the need for prior sample preparation. Reference is made to Z. Takats et al., Science 2004, 306, 471-473 which discloses performing mass spectrometry sampling under ambient conditions using a desorption electrospray ionisation ("DESI") ion source. Various compounds were ionised including peptides and proteins present on metal, polymer and mineral surfaces. Desorption electrospray ionization ("DESI") was carried out by directing an electrosprayed spray of (primary) charged droplets and ions of solvent onto the surface to be analysed. The impact of the charged droplets on the surface produces gaseous ions of material originally present on the surface. Subsequent splashed (secondary) droplets carrying desorbed analyte ions are directed toward an atmospheric pressure interface of a mass and/or ion mobility spectrometer or analyser via a transfer capillary. The resulting mass spectra are similar to normal electrospray mass spectra in that they show mainly singly or multiply charged molecular ions of the analytes. The desorption electrospray ionisation phenomenon was observed both in the case of conductive and insulator surfaces and for compounds ranging from nonpolar small molecules such as lycopene, the alkaloid coniceine, and small drugs, through polar compounds such as peptides and proteins. Changes in the solution that is sprayed can be used to selectively desorb and ionise particular compounds, including those in biological matrices. In vivo analysis was also demonstrated.

It is known that ambient ionisation ion sources such as desorption electrospray ionization ("DESI") may be used to image a sample (e.g. a tissue section). In ambient ionisation mass spectrometry imaging, the spatial distribution of the composition of a sample is visualised by analysing ions produced from multiple spatially separated regions of the sample.

A pre-built model of biomarkers may be used to identify different tissue structures and different types of tissue in a sample. For example, it is known to classify tissue type based upon a previously acquired multivariate statistical model.

Ambient ionisation mass spectrometry imaging systems can suffer from problems due to instability and variability, and may require complex optimisation procedures. This is undesirable and hinders the routine deployment of ambient ionisation mass spectrometry imaging systems.

M. Wood et al., "Microscopic Imaging of Glass Surfaces under the Effects of Desorption Electrospray Ionization", Anal. Chem. 2009, 6407-6415 discloses microscopic imaging techniques to study sample removal from a glass surface by desorption electrospray ionisation ("DESI").

It is desired to provide an improved ambient ionisation ion source.

SUMMARY

According to an aspect there is provided apparatus comprising:

a first ion source arranged and adapted to emit a spray of charged droplets;

a detector or sensor arranged and adapted automatically to detect, sense or determine one or more first parameters or properties of said spray of charged droplets as said spray of charged droplets impacts upon a surface of said detector or sensor; and a control system arranged and adapted to adjust, correct and/or optimise one or more second parameters or properties of the spray of charged droplets based on the one or more first parameters or properties of the spray of charged droplets detected, sensed or determined by the detector or sensor.

According to another aspect there is provided a method comprising:

using a first ion source to emit a spray of charged droplets;

using a detector or sensor automatically to detect, sense or determine one or more first parameters or properties of the spray of charged droplets as the spray of charged droplets impacts upon a surface of the detector or sensor; and (automatically) adjusting, correcting and/or optimising one or more second parameters or properties of the spray of charged droplets based on the one or more first parameters or properties of the spray of charged droplets.

According to various embodiments the detector or sensor may determine, for example, one or more spatial properties of the spray of charged droplets impacting upon a surface of the detector or sensor. In particular, the profile or geometry of the spray of charged droplets impacting upon the surface of the detector may be determined. The control system may then adjust one or more instrumental parameters such as the solvent flow rate of the ion source, a nebulising gas flow rate of the ion source, a (relative) position of the ion source or a (relative) position of the sample and/or a sampling stage in order to optimise the profile or geometry of the spray of charged droplets.

M. Wood et al., "Microscopic Imaging of Glass Surfaces under the Effects of Desorption Electrospray Ionization", Anal. Chem. 2009, 6407-6415 discloses microscopic imaging techniques to study sample removal from a glass surface by desorption electrospray ionisation ("DESI"). However, the disclosed arrangement does not disclose a control system which adjusts parameters of the spray of charged droplets based upon parameters of the spray of charged droplets which are automatically detected, sensed or determined by a detector.

It will be apparent, therefore, that the various present embodiments are particularly beneficial.

According to an aspect there is provided apparatus comprising:

a first ion source arranged and adapted to emit a spray of charged droplets; and a detector or sensor arranged and adapted to detect, sense or determine one or more first parameters or properties of the spray of charged droplets emitted by the first ion source.

The detector or sensor which is arranged to detect, sense or determine one or more parameters or properties of the spray of charged droplets (e.g. the spray spot size) from a sprayer allows the one or more properties or parameters to be determined under substantially the same operating conditions as would be encountered when analysing or imaging a sample. Furthermore, the amount of user input required can be minimised and errors reduced.

The combination of an ambient ionisation ion source and a detector or sensor according to various embodiments is particularly suited to routine deployment because ambient ionisation techniques enable the analysis or imaging of a sample with minimal or no prior preparation, thereby reducing the required amount of user input, while providing a detector or sensor for detecting, sensing or determining one or more parameters or properties of the spray of charged droplets reduces the amount of required user input still further.

Thus according to various embodiments described herein, the quality and reliability of ambient ionisation imaging analysis, e.g. in clinical applications, can be substantially checked and improved, and the amount of user input required can be minimised.

It will be apparent, therefore, that the various present embodiments are particularly beneficial.

The detector or sensor may be further arranged and adapted automatically to detect, sense or determine the one or more first parameters or properties of the spray of charged droplets emitted by the first ion source.

The first ion source may comprise or form part of an ambient ion or ionisation source.

The first ion source may comprise a desorption electrospray ionisation ("DESI") ion source or a desorption electroflow focusing ("DEFFI") ion source.

The first ion source may comprise a solvent emitter.

The apparatus may further comprise a device for supplying a solvent to the solvent emitter.

The solvent may be emitted from the solvent emitter at a flow rate selected from the group consisting of: (i) <0.5 μL/min; (ii) 0.5-1 (iii) 1-2 μL/min; (iv) 2-5 μL/min; (v) 5-10 μL/min; and (vi) >10 μL/min.

The first ion source may comprise a nozzle having an aperture.

The apparatus may further comprise a device for supplying a nebulising gas within the nozzle so that, in use, the nebulising gas exits the nozzle via the aperture.

The solvent emitter may extend through the aperture.

The one or more first parameters or properties of the spray of charged droplets may comprise one or more spatial parameters or properties, one or more calibration parameters or properties, and/or one or more diagnostic parameters or properties of the spray of charged droplets.

The one or more first parameters or properties of the spray of charged droplets may be selected from the group consisting of: (i) one or more parameters related to a geometry, profile, cross-sectional profile, area, cross-sectional area, shape, symmetry, diameter, circumference, width or spot size of the spray of charged droplets; (ii) one or more parameters related to an absolute position, relative position or offset position of the spray of charged droplets; and (iii) one or more parameters related to a quality, accuracy, variability or reproducibility of the spray of charged droplets.

The apparatus may further comprise a sampling stage arranged and adapted to receive a sample.

The apparatus may further comprise a device arranged and adapted to direct the spray of charged droplets at a sample received by the sampling stage and/or to direct the spray of charged droplets so that the detector or sensor detects, senses or determines the one or more first parameters or properties of the spray of charged droplets.

The detector or sensor may be maintained, in use, at a fixed and/or known position relative to the sample and/or sampling stage.

The detector or sensor may be maintained, in use, at a distance from the sample and/or sampling stage selected from the group consisting of: (i)<1 cm; (ii) 1-5 cm; (iii) 5-20 cm; (iv) 20-40 cm; and (v) >40 cm.

The detector or sensor may be substantially integrated with or otherwise provided in or on the sampling stage.

The apparatus may further comprise a control system arranged and adapted to adjust, correct and/or optimise one or more second parameters or properties of the spray of charged droplets based on the one or more first parameters or properties of the spray of charged droplets as detected, sensed or determined by the detector or sensor.

The one or more second parameters or properties of the spray of charged droplets may be the same as or different to the one or more first parameters or properties of the spray of charged droplets.

The one or more second parameters or properties of the spray of charged droplets may comprise one or more spatial parameters or properties, one or more calibration parameters or properties, and/or one or more diagnostic parameters or properties of the spray of charged droplets.

The one or more second parameters or properties of the spray of charged droplets may be selected from the group consisting of: (i) one or more parameters related to a geometry, profile, cross-sectional profile, area, cross-sectional area, shape, symmetry, diameter, circumference, width or spot size of the spray of charged droplets; (ii) one or more parameters related to an absolute position, relative position or offset position of the spray of charged droplets; and (iii) one or more parameters related to a quality, accuracy, variability or reproducibility of the spray of charged droplets.

The one or more second parameters or properties of the spray of charged droplets may be adjusted, corrected and/or optimised by adjusting, correcting and/or optimising one or more instrumental parameters.

The one or more instrumental parameters may be selected from the group consisting of: (i) a solvent flow rate of the first ion source; (ii) a nebulising gas flow rate of the first ion source; (iii) a position of the first ion source; and (iv) a position of the sample and/or sampling stage.

The detector or sensor may be positioned downstream of the first ion source.

The detector or sensor may comprise a pixelated detector comprising an array of pixels.

The detector or sensor may comprise a spatial detector or sensor or a spatial array of detectors or sensors.

The detector or sensor may further comprise a device arranged and adapted to determine the one or more first parameters or properties of the spray of charged droplets using pattern or shape recognition.

The detector or sensor may comprise a charge sensitive detector or sensor.

The charge sensitive detector or sensor may be arranged and adapted to detect, sense or determine a charge on the charged droplets and/or one or more additives added to the spray of charged droplets.

The charge sensitive detector or sensor may comprise a charge coupled device ("CCD"), an electron-multiplying charge coupled device ("CCD"), a conductive detector, an inductive detector, a magnetic detector and/or a capacitive detector.

The detector or sensor may comprise an optical detector or sensor.

The optical detector or sensor may be arranged and adapted to detect, sense or determine directly the one or more first parameters or properties of the spray of charged droplets by observing the spray of charged droplets and/or one or more additives added to the spray of charged droplets.

The detector or sensor may be arranged and adapted to detect, sense or determine the one or more first parameters or properties of the spray of charged droplets as the spray of charged droplets impacts upon a surface of the detector or sensor.

The optical detector or sensor may be arranged and adapted to detect, sense or determine indirectly the one or more first parameters or properties of the spray of charged droplets by observing the spray of charged droplets and/or one or more additives added to the spray of charged droplets.

The optical detector or sensor may be arranged and adapted to detect, sense or determine indirectly the one or more first parameters or properties of the spray of charged droplets by remotely observing the spray of charged droplets and/or one or more additives added to the spray of charged droplets without the spray of charged droplets and/or one or more additives added to the spray of charged droplets impacting upon the optical detector or sensor.

The optical detector or sensor may be arranged and adapted to observe fluorescence of the spray of charged droplets, one or more additives added to the spray of charged droplets and/or a surface of the detector or sensor.

The optical detector or sensor may comprise a charge coupled device ("CCD"), an optical line array, an electron-multiplying charge coupled device ("CCD"), one or more photo diodes, one or more light dependent resistors ("LDRs") and/or a fluorescence detector.

The apparatus may further comprise a control system arranged and adapted to move or scan the spray of charged droplets relative to the detector or sensor.

The detector or sensor may be arranged and adapted to detect, sense or determine one or more profiles of the spray of charged droplets as the spray of charged droplets is moved or scanned relative to the detector or sensor.

The detector or sensor may be arranged and adapted to detect, sense or determine the one or more first parameters or properties of the spray of charged droplets based on the one or more profiles of the spray of charged droplets.

The detector or sensor may comprise a two-dimensional detector or sensor.

The detector or sensor may comprise one or more line detectors.

The detector or sensor may comprise two or more spaced apart detectors.

The two or more spaced apart detectors may be provided at known and/or fixed positions relative to a or the sample, sample slide and/or sampling stage.

The spaced apart detectors may comprise charge sensitive detectors and/or optical detectors.

The detector or sensor may comprise two or more spaced apart chemical or other markers. The spray of charged droplets may be arranged and adapted to ionise the chemical or other markers. The detector or sensor may further comprise a detector arranged and adapted to detect chemical or other markers ionised by the spray of charged droplets.

The two or more spaced apart chemical or other markers may be provided at known and/or fixed positions relative to a or the sample, sample slide and/or sampling stage.

The detector arranged and adapted to detect chemical or other markers ionised by the spray of charged droplets may comprise a mass spectrometer or mass analyser.

According to another aspect there is provided an ambient ionisation ion source comprising apparatus as described above.

According to another aspect there is provided a desorption electrospray ionisation ("DESI") imaging system comprising apparatus as described above.

According to another aspect there is provided a desorption electroflow focusing ionisation ("DEFFI") imaging system comprising apparatus as described above.

According to another aspect there is provided an ion imager comprising apparatus as described above.

According to another aspect there is provided analysis apparatus comprising apparatus as described above.

According to another aspect there is provided a mass spectrometer and/or ion mobility spectrometer comprising apparatus as described above.

According to another aspect there is provided a method comprising:

using a first ion source to emit a spray of charged droplets; and using a detector or sensor to detect, sense or determine one or more first parameters or properties of the spray of charged droplets emitted by the first ion source.

The method may further comprise using the detector or sensor automatically to detect, sense or determine the one or more first parameters or properties of the spray of charged droplets emitted by the first ion source.

The first ion source may comprise or form part of an ambient ion or ionisation source.

The first ion source may comprise a desorption electrospray ionisation ("DESI") ion source or a desorption electroflow focusing ("DEFFI") ion source.

The first ion source may comprise a solvent emitter.

The method may further comprise supplying a solvent to the solvent emitter.

The method may further comprise emitting the solvent from the solvent emitter at a flow rate selected from the group consisting of: (i)<0.5 μL/min; (ii) 0.5-1 μL/min; (iii) 1-2 μL/min; (iv) 2-5 μL/min; (v) 5-10 μL/min; and (vi) >10 μL/min.

The first ion source may comprise a nozzle having an aperture.

The method may further comprise supplying a nebulising gas within the nozzle so that the nebulising gas exits the nozzle via the aperture.

The solvent emitter may extend through the aperture.

The one or more first parameters or properties of the spray of charged droplets may comprise one or more spatial parameters or properties, one or more calibration parameters or properties, and/or one or more diagnostic parameters or properties of the spray of charged droplets.

The one or more first parameters or properties of the spray of charged droplets may be selected from the group consisting of: (i) one or more parameters related to a geometry, profile, cross-sectional profile, area, cross-sectional area, shape, symmetry, diameter, circumference, width or spot size of the spray of charged droplets; (ii) one or more parameters related to an absolute position, relative position or offset position of the spray of charged droplets; and (iii) one or more parameters related to a quality, accuracy, variability or reproducibility of the spray of charged droplets.

The method may further comprise providing a sampling stage for receiving a sample.

The method may further comprise directing the spray of charged droplets at a sample received by the sampling stage and/or directing the spray of charged droplets in order to detect, sense or determine the one or more first parameters or properties of the spray of charged droplets using the detector or sensor.

The method may further comprise maintaining the detector or sensor at a fixed and/or known position relative to the sample and/or sampling stage.

The method may further comprise maintaining the detector or sensor at a distance from the sample and/or sampling stage selected from the group consisting of: (i)<1 cm; (ii) 1-5 cm; (iii) 5-20 cm; (iv) 20-40 cm; and (v) >40 cm.

The detector or sensor may be substantially integrated with or in the sampling stage.

The method may further comprise adjusting, correcting and/or optimising one or more second parameters or properties of the spray of charged droplets based on the one or more first parameters or properties of the spray of charged droplets detected, sensed or determined using the detector or sensor.

The one or more second parameters or properties of the spray of charged droplets may be the same as or different to the one or more first parameters or properties of the spray of charged droplets.

The one or more second parameters or properties of the spray of charged droplets may comprise one or more spatial parameters or properties, one or more calibration parameters or properties and/or one or more diagnostic parameters or properties of the spray of charged droplets.

The one or more second parameters or properties of the spray of charged droplets may be selected from the group consisting of: (i) one or more parameters related to a geometry, profile, cross-sectional profile, area, cross-sectional area, shape, symmetry, diameter, circumference, width or spot size of the spray of charged droplets; (ii) one or more parameters related to an absolute position, relative position or offset position of the spray of charged droplets; and (iii) one or more parameters related to a quality, accuracy, variability or reproducibility of the spray of charged droplets.

The method may further comprise adjusting, correcting and/or optimising the one or more second parameters or properties of the spray of charged droplets by adjusting, correcting and/or optimising one or more instrumental parameters.

The one or more instrumental parameters may be selected from the group consisting of: (i) a solvent flow rate of the first ion source; (ii) a nebulising gas flow rate of the first ion source; (iii) a position of the first ion source; and (iv) a position of the sample and/or sampling stage.

The method may further comprise positioning the detector or sensor downstream of the first ion source.

The detector or sensor may comprise a pixelated detector comprising an array of pixels.

The detector or sensor may comprise a spatial detector or sensor or a spatial array of detectors or sensors.

The method may further comprise using pattern or shape recognition to determine the one or more first parameters or properties of the spray of charged droplets.

The detector or sensor may comprise a charge sensitive detector or sensor.

The method may further comprise using the charge sensitive detector or sensor to detect, sense or determine a charge on the charged droplets and/or one or more additives added to the spray of charged droplets.

The charge sensitive detector or sensor may comprise a charge coupled device ("CCD"), an electron-multiplying charge coupled device ("CCD"), a conductive detector, an inductive detector, a magnetic detector and/or a capacitive detector.

The detector or sensor may comprise an optical detector or sensor.

The method may further comprise using the optical detector or sensor to detect, sense or determine directly the one or more first parameters or properties of the spray of charged droplets by observing the spray of charged droplets and/or one or more additives added to the spray of charged droplets.

The method may further comprise detecting, sensing or determining the one or more first parameters or properties of the spray of charged droplets as the spray of charged droplets impacts upon a surface of the detector or sensor.

The method may further comprise using the optical detector or sensor to detect, sense or determine indirectly the one or more first parameters or properties of the spray of charged droplets by observing the spray of charged droplets and/or one or more additives added to the spray of charged droplets.

The method may further comprise remotely observing the spray of charged droplets and/or one or more additives added to the spray of charged droplets without the spray of charged droplets and/or one or more additives added to the spray of charged droplets impacting upon the optical detector or sensor in order to detect, sense or determine indirectly the one or more first parameters or properties of the spray of charged droplets using the optical detector or sensor.

The method may further comprise observing fluorescence of the spray of charged droplets, one or more additives added to the spray of charged droplets and/or a surface of the detector or sensor using the optical detector or sensor.

The optical detector or sensor may comprise a charge coupled device ("CCD"), an optical line array, an electron-multiplying charge coupled device ("CCD"), one or more photo diodes, one or more light dependent resistors ("LDRs") and/or a fluorescence detector.

The method may further comprise moving or scanning the spray of charged droplets relative to the detector or sensor.

The method may further comprise using the detector or sensor to detect, sense or determine one or more profiles of the spray of charged droplets as the spray of charged droplets is moved or scanned relative to the detector or sensor.

The method may further comprise using the one or more profiles of the spray of charged droplets to detect, sense or determine the one or more first parameters or properties of the spray of charged droplets.

The detector or sensor may comprise a two-dimensional detector or sensor.

The detector or sensor may comprise one or more line detectors.

The detector or sensor may comprise two or more spaced apart detectors.

The method may further comprise providing the two or more spaced apart detectors at known and/or fixed positions relative to a or the sample, sample slide and/or sampling stage.

The spaced apart detectors may comprise charge sensitive detectors and/or optical detectors.

The detector or sensor may comprise two or more spaced apart chemical or other markers. The method may further comprise using the spray of charged droplets to ionise the chemical or other markers and detecting the chemical or other markers ionised by the spray of charged droplets.

The method may further comprise providing the two or more spaced apart chemical or other markers at known and/or fixed positions relative to a or the sample, sample slide and/or sampling stage.

The method may further comprise using a mass spectrometer or mass analyser to detect the chemical or other markers ionised by the spray of charged droplets.

According to another aspect there is provided a method of ambient ionisation comprising a method as described above.

According to another aspect there is provided a method of desorption electrospray ionisation ("DESI") imaging comprising a method as described above.

According to another aspect there is provided a method of desorption electroflow focusing ionisation ("DEFFI") imaging comprising a method as described above.

According to another aspect there is provided a method of ion imaging comprising a method as described above.

According to another aspect there is provided a method of analysis comprising a method as described above.

According to another aspect there is provided a method of surgery, diagnosis, therapy or medical treatment comprising a method as described above.

According to another aspect there is provided a non-surgical, non-therapeutic method of mass spectrometry and/or ion mobility spectrometry comprising a method as described above.

According to another aspect there is provided a method of mass spectrometry and/or ion mobility spectrometry comprising a method as described above.

BRIEF DESCRIPTION OF THE DRAWINGS

Various embodiments will now be described, by way of example only, and with reference to the accompanying drawings in which.

DETAILED DESCRIPTION

Figure 1:
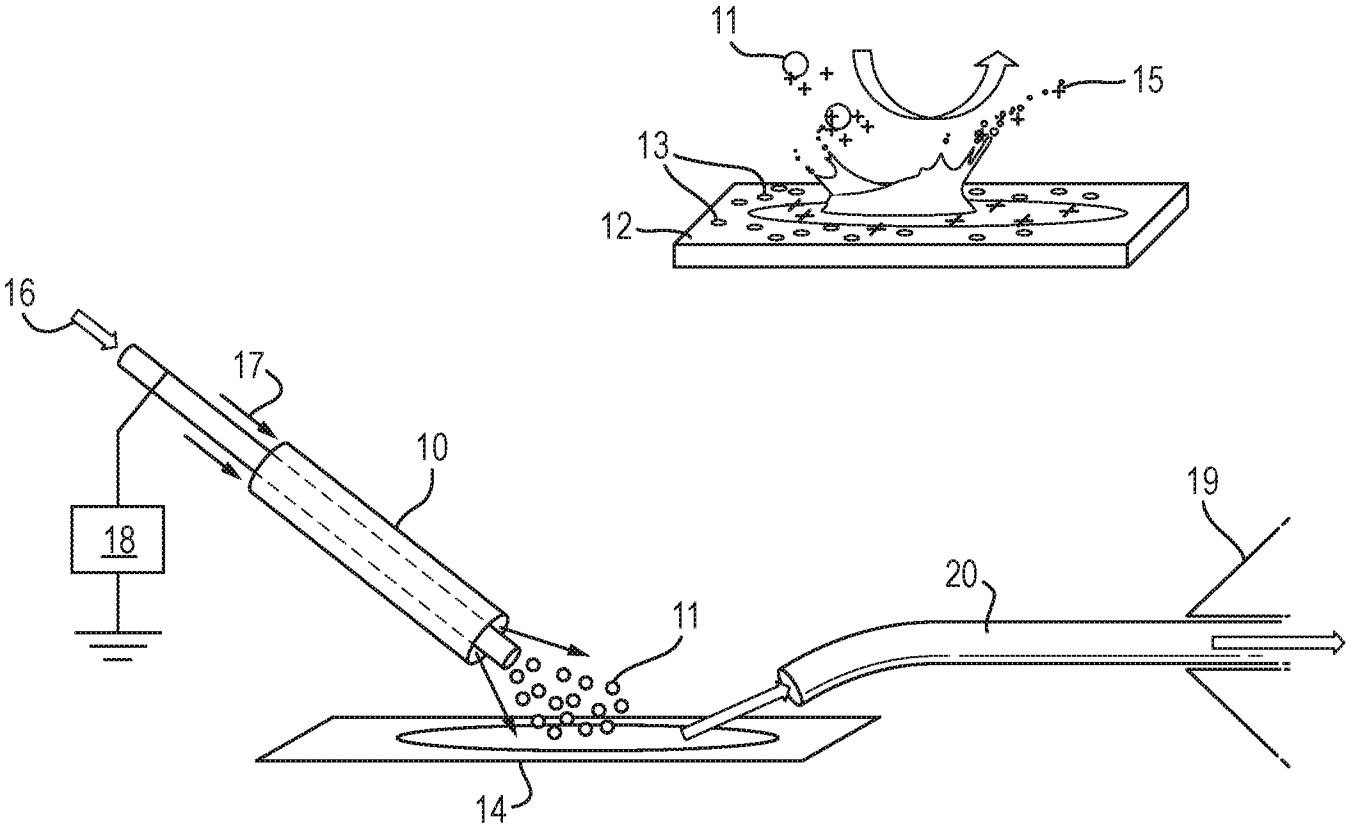
FIG. 1 illustrates schematically the desorption electrospray ionisation ("DESI") technique.

Various embodiments are directed to methods of and apparatus for ambient ionisation mass spectrometry imaging wherein an ambient ionisation ion source emits a spray of charged droplets.

According to various embodiments a device may be used to generate analyte ions from one or more regions of a target or sample (e.g. ex vivo tissue). The device may comprise an ambient ionisation ion source which is characterised by the ability to analyse a native or unmodified target or sample. For example, other types of ionisation ion sources such as Matrix Assisted Laser Desorption Ionisation ("MALDI") ion sources require a matrix or reagent to be added to the sample prior to ionisation.

It will be apparent that the requirement to add a matrix or a reagent to a sample prevents the ability to perform in vivo analysis of tissue and also, more generally, prevents the ability to provide a rapid simple analysis of target material.

In contrast, therefore, ambient ionisation techniques are particularly advantageous since firstly they do not require the addition of a matrix or a reagent (and hence are suitable for the analysis of in vivo tissue) and since secondly they enable a rapid simple analysis of target material to be performed.

A number of different ambient ionisation techniques are known. As a matter of historical record, desorption electrospray ionisation ("DESI") was the first ambient ionisation technique to be developed and was disclosed in 2004. Since 2004, a number of other ambient ionisation techniques have been developed. These ambient ionisation techniques differ in their precise ionisation method but they share the same general capability of generating gas-phase ions directly from native (i.e. untreated or unmodified) samples. A particular advantage of the various ambient ionisation techniques is that the various ambient ionisation techniques do not require any prior sample preparation. As a result, the various ambient ionisation techniques enable both in vivo tissue and ex vivo tissue samples to be analysed without necessitating the time and expense of adding a matrix or reagent to the tissue sample or other target material.

A list of ambient ionisation techniques is given in the following table:

| Acronym | Ionisation technique |
|---|---|
| DESI | Desorption electrospray ionization |
| DeSSI | Desorption sonic spray ionization |
| DAPPI | Desorption atmospheric pressure photoionization |
| EASI | Easy ambient sonic-spray ionization |
| JeDI | Jet desorption electrospray ionization |
| TM-DESI | Transmission mode desorption electrospray ionization |
| LMJ-SSP | Liquid microjunction-surface sampling probe |
| DICE | Desorption ionization by charge exchange |
| Nano-DESI | Nanospray desorption electrospray ionization |
| EADESI | Electrode-assisted desorption electrospray ionization |
| APTDCI | Atmospheric pressure thermal desorption chemical ionization |
| V-EASI | Venturi easy ambient sonic-spray ionization |
| AFAI | Air flow-assisted ionization |
| LESA | Liquid extraction surface analysis |
| PTC-ESI | Pipette tip column electrospray ionization |
| AFADESI | Air flow-assisted desorption electrospray ionization |
| DEFFI | Desorption electro-flow focusing ionization |
| ESTASI | Electrostatic spray ionization |
| PASIT | Plasma-based ambient sampling ionization transmission |
| DAPCI | Desorption atmospheric pressure chemical ionization |
| DART | Direct analysis in real time |
| ASAP | Atmospheric pressure solid analysis probe |
| APTDI | Atmospheric pressure thermal desorption ionization |
| PADI | Plasma assisted desorption ionization |
| DBDI | Dielectric barrier discharge ionization |
| FAPA | Flowing atmospheric pressure afterglow |
| HAPGDI | Helium atmospheric pressure glow discharge ionization |
| APGDDI | Atmospheric pressure glow discharge desorption ionization |
| LTP | Low temperature plasma |
| LS-APGD | Liquid sampling-atmospheric pressure glow discharge |
| MIPDI | Microwave induced plasma desorption ionization |
| MFGDP | Microfabricated glow discharge plasma |
| RoPPI | Robotic plasma probe ionization |
| PLASI | Plasma spray ionization |
| MALDESI | Matrix assisted laser desorption electrospray ionization |
| ELDI | Electrospray laser desorption ionization |
| LDTD | Laser diode thermal desorption |
| LAESI | Laser ablation electrospray ionization |
| CALDI | Charge assisted laser desorption ionization |
| LA-FAPA | Laser ablation flowing atmospheric pressure afterglow |
| LADESI | Laser assisted desorption electrospray ionization |
| LDESI | Laser desorption electrospray ionization |
| LEMS | Laser electrospray mass spectrometry |
| LSI | Laser spray ionization |
| IR-LAMICI | Infrared laser ablation metastable induced chemical ionization |
| LDSPI | Laser desorption spray post-ionization |
| PAMLDI | Plasma assisted multiwavelength laser desorption ionization |
| HALDI | High voltage-assisted laser desorption ionization |
| PALDI | Plasma assisted laser desorption ionization |
| ESSI | Extractive electrospray ionization |
| PESI | Probe electrospray ionization |
| ND-ESSI | Neutral desorption extractive electrospray ionization |
| PS | Paper spray |
| DIP-APCI | Direct inlet probe-atmospheric pressure chemical ionization |
| TS | Touch spray |
| Wooden-tip | Wooden-tip electrospray |
| CBS-SPME | Coated blade spray solid phase microextraction |
| TSI | Tissue spray ionization |
| RADIO | Radiofrequency acoustic desorption ionization |
| LIAD-ESI | Laser induced acoustic desorption electrospray ionization |
| SAWN | Surface acoustic wave nebulization |
| UASI | Ultrasonication-assisted spray ionization |
| SPA-nanoESI | Solid probe assisted nanoelectrospray ionization |
| PAUSI | Paper assisted ultrasonic spray ionization |
| DPESI | Direct probe electrospray ionization |
| ESA-Py | Electrospray assisted pyrolysis ionization |
| APPIS | Ambient pressure pyroelectric ion source |
| RASTIR | Remote analyte sampling transport and ionization relay |
| SACI | Surface activated chemical ionization |
| DEMI | Desorption electrospray metastable-induced ionization |

-continued

| Acronym | Ionisation technique |
|---|---|
| REIMS | Rapid evaporative ionization mass spectrometry |
| SPAM | Single particle aerosol mass spectrometry |
| TDAMS | Thermal desorption-based ambient mass spectrometry |
| MAII | Matrix assisted inlet ionization |
| SAII | Solvent assisted inlet ionization |
| SwiFERR | Switched ferroelectric plasma ionizer |
| LPTD | Leidenfrost phenomenon assisted thermal desorption |

According to an embodiment the ambient ionisation ion source may comprise a desorption electrospray ionisation ("DESI") ion source.

However, it will be appreciated that other ambient ion sources including those referred to above that emit a spray of charged droplets may also be utilised. For example, according to another embodiment the ambient ionisation ion source may comprise a desorption electro-flow focusing ("DEFFI") ion source.

Desorption electrospray ionisation ("DESI") allows direct and fast analysis of surfaces without the need for prior sample preparation. Biological compounds such as lipids, metabolites and peptides may be ionised at atmospheric pressure and analysed in their native state without requiring any advance sample preparation. The technique according to various embodiments will now be described in more detail with reference to FIG. 1.

As shown in FIG. 1, the desorption electrospray ionisation ("DESI") technique is an ambient ionisation method that involves directing a spray of (primary) electrically charged droplets 11 onto a surface 12 with analyte 13 present on the surface 12 and/or directly onto a surface of a sample 14. The electrospray mist is pneumatically directed at the sample by a sprayer 10 (e.g. a first ion source) where subsequent splashed (secondary) droplets 15 carry desorbed ionised analytes (e.g. desorbed lipid ions). The sprayer 10 may be supplied with a solvent 16, a nebulising gas 17 such as nitrogen, and voltage from a high voltage ("HV") source 18. After ionisation, the ions may travel through air into an atmospheric pressure interface 19 of a mass spectrometer or mass analyser (not shown), e.g. via a transfer capillary 20. The ions may then be analysed to determine their mass to charge ratio and/or ion mobility, or to determine the mass to charge ratio and/or ion mobility of ions derived from the initial ions (e.g. by fragmenting the initial ions), etc.

Desorption electroflow focussing ionisation ("DEFFI") is a recently developed ambient ionisation technique, in which an electroFlow Focusing (RTM) nebuliser is used to desorb ions from a sample surface. This nebuliser focusses the emitted electrospray through a small orifice in a grounded plate using a concentric gas flow. Unlike desorption electrospray ionisation ("DESI"), which may use very high nebulising gas pressures (e.g. 100 psi) and high electrospray voltages (e.g. 4.5 to 5 kV), desorption electroflow focusing ionisation ("DEFFI") has so far been operated at relatively low gas pressures (e.g. 10 psi) and lower voltages (e.g. 500 V), as higher voltages were reported to cause droplet discharge at the orifice and corona discharge.

Desorption electrospray ionisation ("DESI") is of particular interest in the context of imaging mass spectrometry, since it can be used to analyse a sample (e.g. tissue section) whilst leaving it virtually unaltered. Accordingly, a particular benefit of utilising desorption electrospray ionisation ("DESI") to analyse or image a sample (e.g. tissue section) in accordance with various embodiments is that desorption electrospray ionisation ("DESI") analysis allows for multiple interrogations of the same part of the sample (tissue section). This is not the case with many other types of ionisation, such as Matrix-Assisted Laser Desorption Ionisation ("MALDI").

Desorption electrospray ionisation ("DESI") is a versatile ionisation technique for mass spectrometry for surfaces under ambient conditions, and does not require a sample to be under vacuum or cooled, nor does it require time consuming sample preparation steps.

Ambient ionisation mass spectrometry imaging systems (such as desorption electrospray ionisation ("DESI") imaging systems) can, however, suffer from problems due to instability and variability. For example, variations in instrumental and/or environmental parameters or properties may affect the diagnostic abilities of the imaging system.

These effects may impact the diagnostic quality of the imaging system and the sensitivity and specificity of an analysis, and may prevent the routine deployment of ambient ionisation mass spectrometry imaging systems into e.g. histopathology laboratories in a diagnostic manner.

Furthermore, ambient ionisation mass spectrometry imaging systems may require complex optimisation procedures which may be time consuming and require user input. This may be undesirable in routine deployment due to, for example, cost.

Various embodiments described herein are directed to an apparatus comprising a first ion source 10 that emits a spray of charged droplets 11, such as a desorption electrospray ionisation ("DESI") ion source. A detector or sensor is arranged to detect, sense or determine one or more parameters or properties of the spray of charged droplets 11. The detector or sensor may be arranged to automatically detect, sense or determine the one or more parameters or properties of the spray of charged droplets 11.

The first ion source 10 may comprise an ambient ionisation ion source, such as a desorption electrospray ionization ("DESI") ion source or a desorption electro-flow focusing ("DEFFI") ion source. In various embodiments, the first ion source 10 may comprise a solvent emitter, and a device for supplying a solvent to the solvent emitter may be provided. The first ion source 10 may further comprise a nozzle having an aperture. A device for supplying a nebulising gas within the nozzle may be provided so that the nebulising gas exits the nozzle via the aperture. The solvent emitter may extend through the aperture.

The approach according to various embodiments aids the routine deployment of ambient ionisation imaging systems (such as desorption electrospray ionization ("DESI") imaging systems) into e.g. a histopathology laboratory in a diagnostic manner. Critical parameters that may affect the diagnostic abilities of the imaging system may be validated, automatically optimised or checked prior to data collection and also post data collection.

For example, one critical parameter in mass spectrometry imaging is the ionisation spot size, i.e., the size of each of multiple spatially separated regions of a sample from which ions are analysed. In desorption electrospray ionisation ("DESI") ionisation and imaging, a number of important parameters relate to the quality and diagnostic ability due to the spray point or spray spot, e.g. the spray spot size, the analysis area size and the spray spot shape or symmetry.

According to various embodiments, other parameters or properties of the spray of charged droplets may include: one or more spatial parameters or properties, such as one or more parameters related to the geometry, profile, cross-sectional profile, area, cross-sectional area, shape, symmetry, diameter, circumference, width or spot size of the spray of charged droplets; one or more calibration parameters or properties, such as one or more parameters related to the absolute position, relative position or offset position of the spray of charged droplets; and/or one or more diagnostic parameters or properties, such as one or more parameters related to the quality, accuracy, variability or reproducibility of the spray of charged droplets.

It will be appreciated that these parameters may impact the diagnostic ability of an imaging system. For example, the spray spot size may affect the imaging resolution—e.g. in a low resolution mode of operation the spray of charged droplets may have a relatively large spot size, while in a high resolution mode of operation the spray of charged droplets may have a relatively small spot size.

There are a number of different instrumental parameters which may impact upon or control the desorption electrospray ionisation ("DESI") spray and its parameters or properties such as spot size, shape and position including: (i) the sprayer position; (ii) the height above a sample (e.g. tissue) relative to a sampling orifice or capillary of the mass spectrometer; and (iii) the position (e.g. height and angle) of the sprayer itself relative to the above. Additionally, the solvent flow rate and nebulising gas flow may have an impact. Environmental parameters, such as temperature, pressure and humidity, may also have an effect.

Intended or unintended variations in one or more of the above factors may impact e.g. the spray spot size, shape and position, and the diagnostic abilities of the imaging system.

Figure 2A:
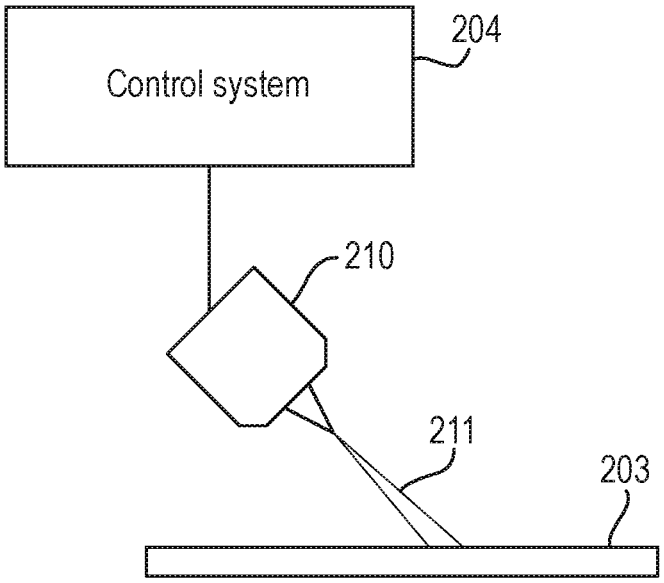
FIG. 2A shows an embodiment in which a spray of charged droplets has a relatively small spot size and FIG. 2B shows an embodiment in which a spray of charged droplets has a relatively large spot size.
Figure 2B:
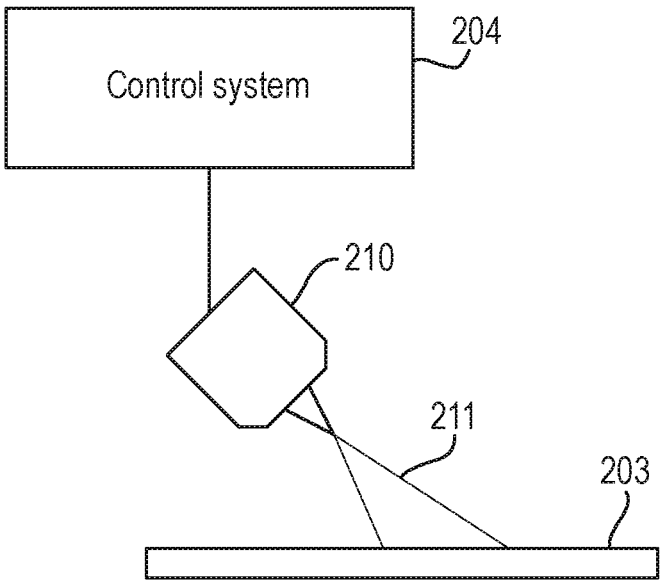

For example, FIGS. 2A and 2B show embodiments in which a first ion source 210 (e.g. a desorption electrospray ionisation ("DESI") ion source) is arranged to emit a spray of charged droplets 211. The first ion source 210 may have a variable spray spot size. Variations in the spray spot size may be intended, e.g. due to a desire from a user to change the spot size, or unintended, e.g. due to environmental and/or instrumental variations. For example, as shown in FIGS. 2A and 2B, the spray 211 may have a relatively small spot size (FIG. 2A) or a relatively large spot size (FIG. 2B) with the spot size being controlled by a control system 204. A detector or sensor 203 may be arranged to determine the spray spot size (or more generally one or more parameters or properties of the spray of charged droplets 211) impacting upon the detector or sensor 203. The detector or sensor 203 may be positioned downstream of the first ion source 210 and spray of charged droplets 211 and the charged droplets 211 may be arranged to impact an upper or first surface of the detector or sensor 203.

The determined one or more parameters or properties (e.g. spray spot size) of the spray of charged droplets 211 may then be used for validation, optimisation and/or checking purposes. For example, the determined spray spot size may be used to check that an unintended variation in spray spot size has not occurred. Similarly, the determined spray spot size may be used to check that an intended spray spot size adjustment has occurred as intended. Furthermore, and as will be described in more detail below, the determined spray spot size may be used to adjust, correct or optimise the sprayer and/or spray spot.

As mentioned above, ambient ionization mass spectrometry imaging systems, such as desorption electrospray ionisation ("DESI") imaging systems, may require complex optimisation procedures which may be time consuming and require user input. Conventionally, an attempt may be made to adjust the desorption electrospray ionisation ("DESI") spot manually with essentially no feedback to the user as to how the changes made are affecting the spray. This approach might involve, e.g. running the sprayer at an artificially high (e.g. 10 μL/min) flow rate to provide enhanced visibility of the spray initially. The sprayer design allows the spot size to be controlled using gas flow and solvent flow rates. Once the sprayer spot size is as desired, the sprayer may then be operated at lower (normal) flow rates (e.g. 0.5 to 2 μL/min) in order to analyse or image a sample. Accordingly, a conventional approach would involve the manual positioning of a sampling stage and manually observing the spray.

One problem with such a conventional approach to sprayer (first ion source) optimisation is that the sprayer is run at an artificially high (e.g. 10 μL/min) flow rate so that the spray is visible to a user whilst the spray spot is adjusted and/or optimised. The flow rate may then be reduced to a normal, lower rate (e.g. 0.5 to 2 μL/min) in order to analyse or image a sample. This means that the operating conditions that the sprayer is operated under when initially adjusting or optimising the sprayer and/or spray spot size are different to the operating conditions that the sprayer is operated under when subsequently analysing or imaging a sample. This may lead to errors and uncertainties in, e.g. sprayer spot size determination, adjustments or optimisation. Errors may also be introduced due to the fact that the sprayer spot size may be affected by the different solvent flow rates.

Another problem with the conventional approach is that it is relatively time consuming and requires a degree of user skill and input which may not be available or may not be desirable in routine deployment due to, e.g. cost. Furthermore, the conventional approach may be prone to user error.

Accordingly, providing a detector or sensor 203 to detect, sense or determine one or more parameters or properties of the spray of charged droplets 211 (e.g. the spray spot size) from a sprayer, according to various embodiments allows the one or more properties or parameters to be determined under substantially the same operating conditions as would be encountered when analysing or imaging a sample, and furthermore the amount of user input required can be minimised and hence errors reduced.

The combination of an ambient ionisation ion source and a detector or sensor 203 according to various embodiments may be particularly suited to routine deployment since, as described above, ambient ionisation techniques enable the analysis or imaging of a sample with minimal or no prior preparation, thereby reducing the required amount of user input, while providing a detector or sensor 203 for detecting, sensing or determining one or more parameters or properties of the spray of charged droplets 211 may reduce the amount of required user input still further.

Thus according to various embodiments described herein, the quality and reliability of ambient ionisation imaging analysis, e.g. in clinical applications, can be substantially checked and improved, and the amount of user input required can be minimised.

In an ambient ionisation imaging system (such as a desorption electrospray ionisation ("DESI") imaging system), and in particular a diagnostic imaging system, critical parameters include the sprayer spot size and parameters relating to the spray geometry and symmetry. Conventional optimisation methods may require the intervention of an operator and/or operation at a different setting than the actual analysis of a sample is performed under. The various embodiments provide the ability to measure one or more parameters or properties of the spray 211 (e.g. the spot size and parameters relating to spray geometry and symmetry) under actual operating conditions in an automated manner.

According to various embodiments, the apparatus may further comprise a sampling or imaging stage for receiving a sample. The spray of charged droplets 211 may then be directed at one or more spatially separated regions of the sample in order to analyse and/or image the sample. The spray of charged droplets 211 may also be directed so that the one or more properties of the spray of charged droplets 211 (e.g. the spray spot size) is determined by the detector or sensor 203. The detector or sensor 203 may be maintained, in use, at a fixed and/or known position relative to the sample or sampling stage. Additionally or alternatively, the detector or sensor 203 may be substantially integrated with or otherwise provided in or on the sampling stage.

Figure 3:
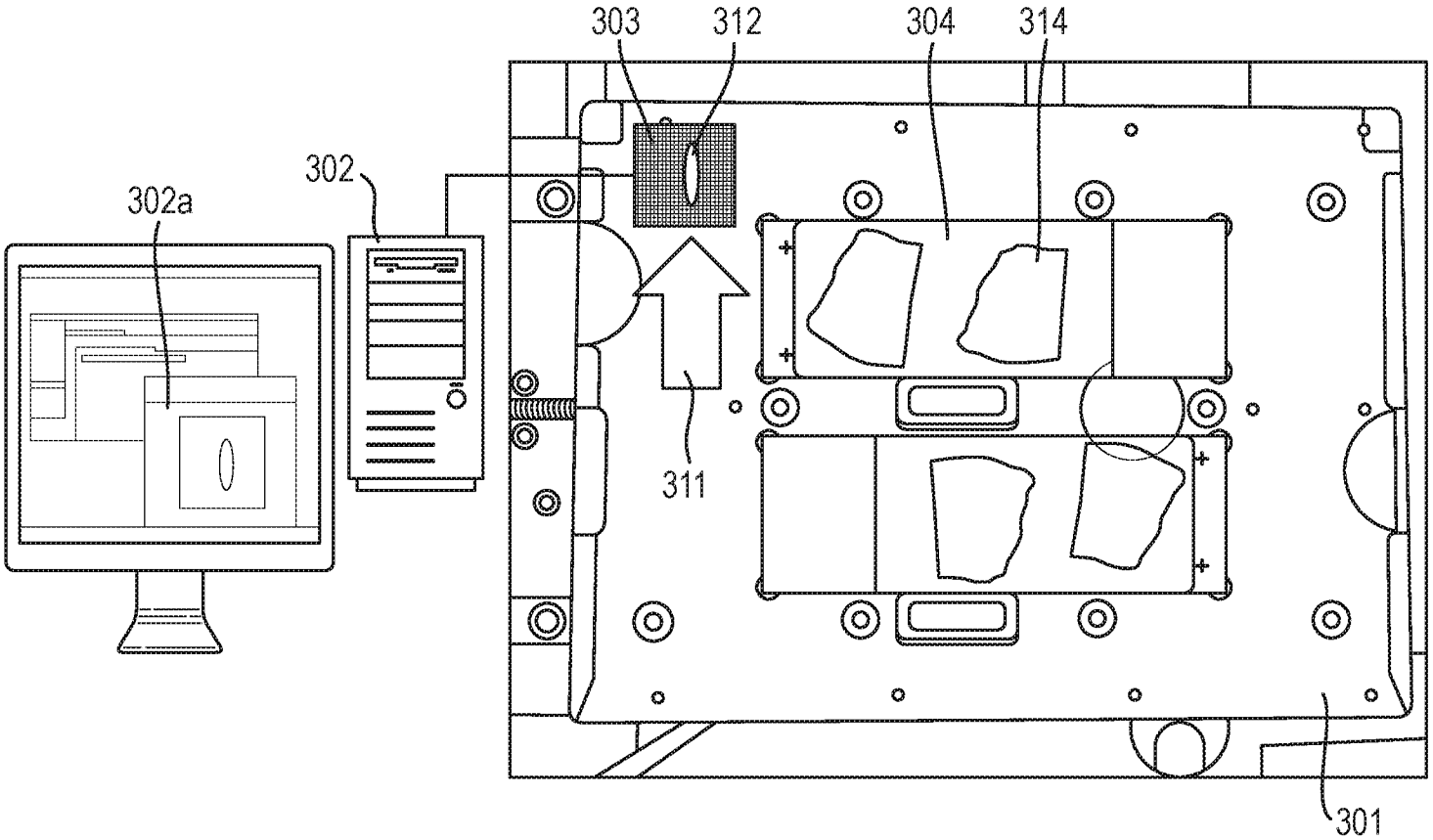
FIG. 3 shows the implementation of a measurement region onto a desorption electrospray ionisation ("DESI") sampling or imaging stage wherein the measurement region either comprises high density sensors or a region covered by a camera which measures fluorescence from the surface or from the solvent.

For example, FIG. 3 shows an embodiment wherein a detector or a sensor comprising a measurement region 303 is implemented onto a desorption electrospray ionisation ("DESI") sampling stage 301. A spray of charged droplets 311 may be directed onto a surface of the measurement region 303 such that one or more parameters or properties of the spray spot 312 impacting upon the surface of the measurement region 303 may be determined. As will be described in more detail below, the measurement region 303 may comprise, for example, high density sensors or a region covered by a camera which measures fluorescence from the surface or from a solvent of the spray of charged droplets 311. The detector or sensor may comprise a computer 302 connected to the measurement region 303 and which runs software 302*a* arranged to determine the one or more parameters or properties of the spray of charged droplets using measurements from the measurement region 303. A sample or samples 314 may be mounted on a sample slide 304 and received by the sampling stage 301.

Figure 4A:
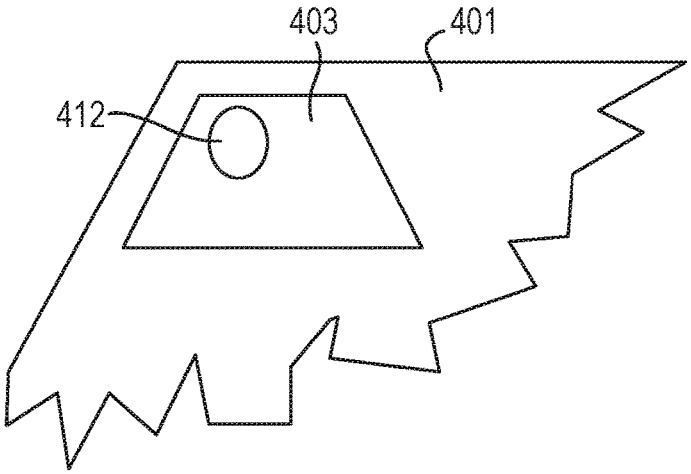
FIG. 4A shows an embodiment wherein the physical impact of the desorption electrospray ionisation ("DESI") spray spot onto a surface is interpreted by software which determines the shape and position of the desorption electrospray ionisation ("DESI") spray spot.
Figure 4B:
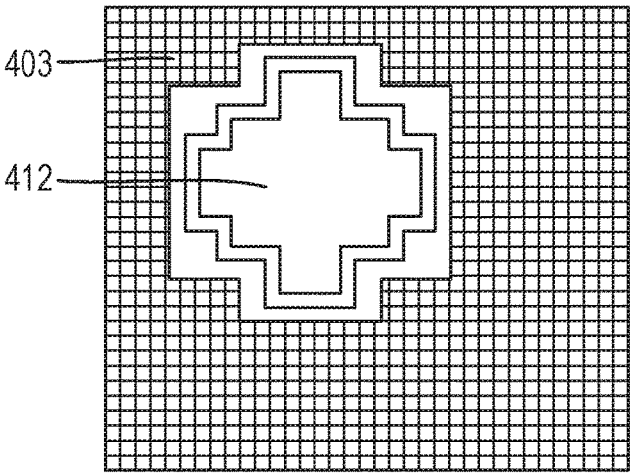
FIG. 4B shows an embodiment wherein the physical impact of the desorption electrospray ionisation ("DESI") spray spot onto a surface is interpreted by software which determines the shape and position of the desorption electrospray ionisation ("DESI") spray spot and FIG. 4C illustrates a spray spot size measurement and position determination using software.
Figure 4C:
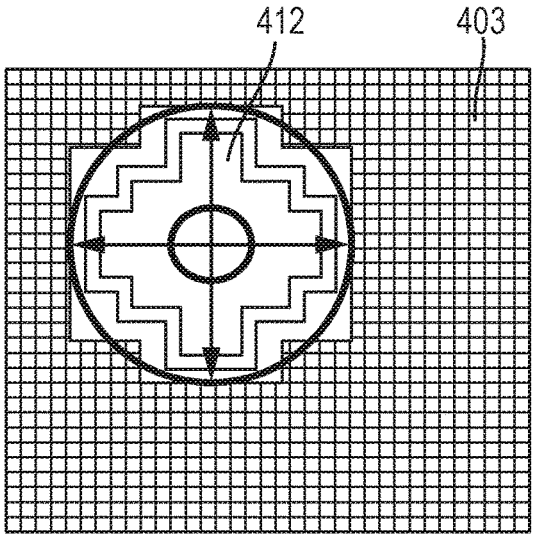

FIGS. 4A-C illustrate an embodiment wherein the spray of charged droplets is directed at a surface of a measurement region or detector array 403 (i.e. a detector or a sensor) that may be integrated with a sampling stage 401. The spray spot 412 may be initially off-centre in the top left corner of the detector array 403, indicating that the spray of charged droplets may be out of alignment with the detector array 403 and/or the sampling stage 401. Furthermore, the spray spot 412 may be diffuse, i.e. the spray spot size may be bigger than desired.

As illustrated in FIG. 4C, the spray spot centre position and the spray spot size (i.e. one or more parameters or properties of the spray of charged droplets) may then be determined. This may involve using pattern or shape recognition software to determine the spray spot centre position and the spray spot size.

It will be appreciated that the detector or sensor may detect, sense or determine the one or more parameters or properties of the spray of charged droplets prior to analysing or imaging a sample, at the same time as analysing or imaging a sample and/or after analysing or imaging a sample. Furthermore, the detector or sensor may detect, sense or determine the one or more parameters or properties of the spray of charged droplets without there being a sample or sampling stage—i.e. not in connection with analysing or imaging a sample. For example, in an embodiment, the detector or sensor may detect, sense or determine the one or more parameters or properties of the spray of charged droplets as part of a quality assurance or start-up procedure.

The detector or sensor may be provided at a fixed and/or known position relative to the sample or sampling stage, thereby advantageously providing a zero-zero point which may be used, e.g. for aligning an ion image of a sample with optical images of the sample. One or more calibration parameters, e.g. related to the absolute position, relative position or offset position of the spray of charged droplets, may be determined, and offsets may be calibrated so that the exact position of the sprayer relative to the sampling stage, sample slide and/or sample may be known or determined.

Thus according to an embodiment, a desorption electrospray ionisation ("DESI") spray point or spray spot measurement region (i.e. a detector or sensor) may be included within or integrated with or in an imaging or sampling stage and/or may be provided in the locality of the imaging or sampling stage so that the spray spot may be accurately and automatically measured and recorded at operating conditions. This measurement may then be used to streamline an optimisation process. The various embodiments allow for, e.g. accurate measurement of the spray spot size on a surface and may also be useful in providing a zero-zero point for e.g. alignment with optical images for defining regions of analysis. Offsets may be calibrated so that the exact position of the sprayer relative to the sampling stage, sample slide and/or sample may be known or determined.

This may be achieved relatively quickly without the need for a separate apparatus and with minimal user input. The detector or sensor and the sample or sampling stage may be maintained at substantially the same and/or known operating conditions. For example, instrumental and environmental parameters of the detector or sensor and the sampling stage or sample, such as temperature, pressure and humidity may be substantially the same and/or known. As a result, the one or more parameters or properties of the spray of charged droplets (e.g. spray spot size) may be determined at operating conditions that are substantially the same as the operating conditions that would be encountered when analysing or imaging a sample. Errors that might otherwise be introduced due to differing operating conditions may accordingly be avoided or minimised.

According to various embodiments, the apparatus may further comprise a control system arranged to adjust, correct and/or optimise one or more second parameters or properties of the spray of charged droplets based on the determined one or more first parameters or properties of the spray of charged droplets. The first one or more parameters or properties may be same as or different to the second one or more parameters or properties.

Figure 5:
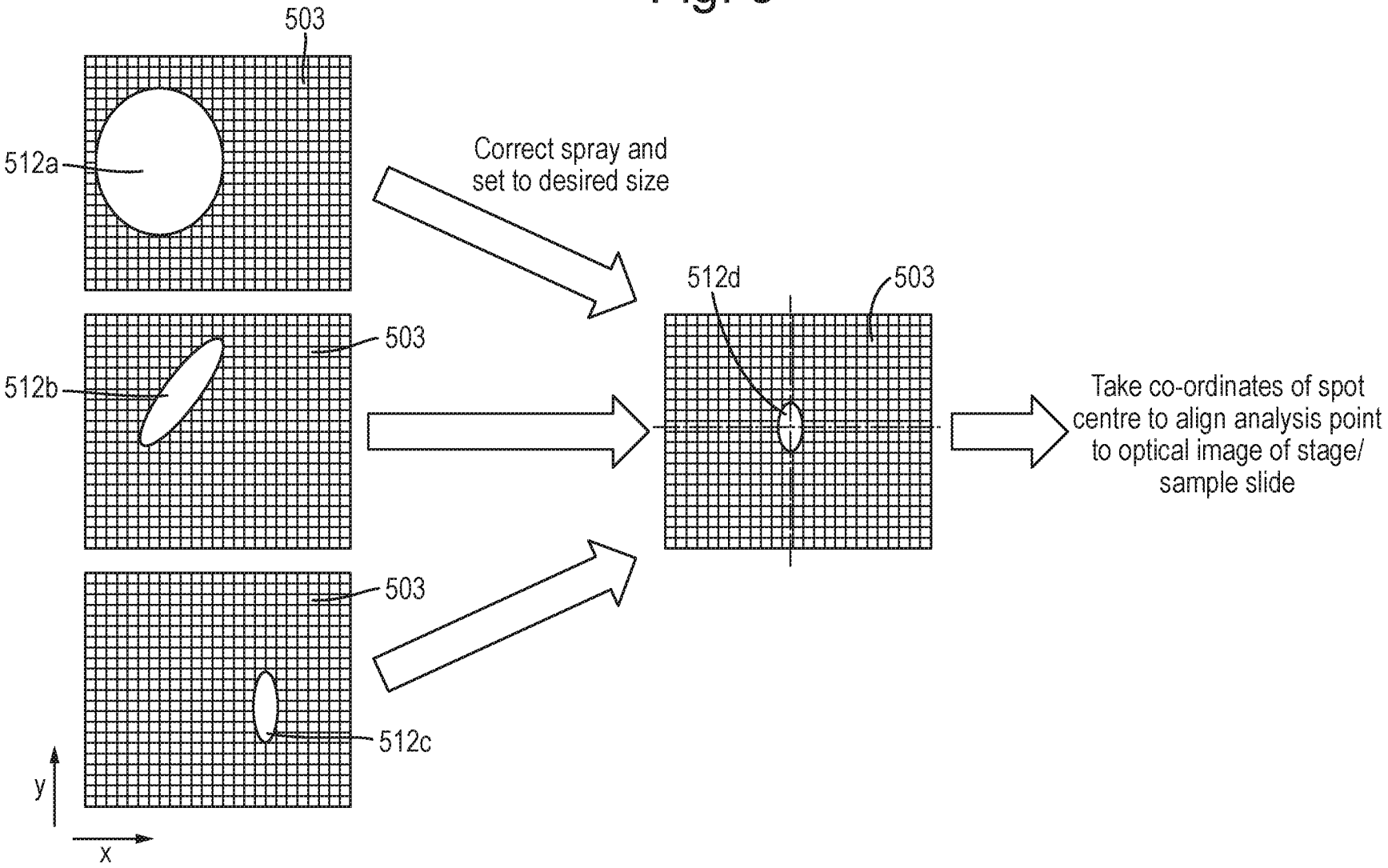
FIG. 5 illustrates an embodiment wherein the size and/or position of a desorption electrospray ionisation ("DESI") spray spot is automatically adjusted, corrected or optimised.

For example, FIG. 5 schematically illustrates an embodiment wherein software control of the sampling stage x, y and z positions, the nebuliser gas flow and the solvent flow may be implemented automatically to reach a desired spray spot size, spray spot shape and positional offset.

FIG. 5 illustrates three initial spray spots 512*a*,512*b*,512*c* impacting upon a measurement region or detector array 503 (i.e. a detector or sensor). Spray spot 512*a* is off-centre towards the top-left of the detector array 503 and the spray spot size is bigger than desired in x and y dimensions of the detector array 503. Spray spot 512*b* is off-centre towards the top-left of the detector array 503 and the spray spot size is bigger than desired and the spray spot shape is skewed i.e. the spray spot is not symmetric about x and y dimensions of the detector array 503. Spray spot 512*c* is off-centre towards the bottom-right of the detector array 503 and the spray spot size is bigger than desired in the y dimension of the detector array 503.

For each of the spray spots 512*a*,512*b*,512*c* the spray spot centre position, the spray spot size and the spray spot shape and/or symmetry (i.e. one or more first parameters or properties of the spray of charged droplets) may then be determined as described above (e.g. in connection with the method and apparatus as described above with reference to e.g. FIG. 3 and FIGS. 4A-C) using the detector array 503. This may involve using pattern or shape recognition software to determine the spray spot centre position, size, shape and/or symmetry.

The spray spot centre position, size, shape and/or symmetry (i.e. one or more second parameters or properties of the spray of charged droplets) may then be adjusted, corrected or optimised based on the determined spray spot centre position, size, shape and/or symmetry (i.e. the determined one or more first parameters or properties of the spray of charged droplets).

This may be achieved by adjusting one or more instrumental parameters, such as the flow rate of the nebulising gas of the desorption electrospray ionisation ("DESI") ion source (first ion source), the flow rate of the solvent of the desorption electrospray ionisation ("DESI") ion source (first ion source), and the position of the sampling stage, sample slide and/or sample relative to the desorption electrospray ionisation ("DESI") sprayer (first ion source).

As illustrated in FIG. 5, the adjusted spray spot 512*d* may be positioned so as to be at the centre of the detector array 503, and may be arranged so as to have a desired spray spot size and shape. The spray spot centre position, the spray spot size and the spray spot shape and/or symmetry (i.e. one or more parameters or properties) of the adjusted spray of charged droplets may be determined as described above (e.g. in connection with the method and apparatus as described above with reference to FIG. 3 and FIGS. 4A-C) using the detector array 503. It will be appreciated that the detector array 503 may detect, sense or determine one or more parameters or properties of the adjusted spray of charged droplets as part of and/or after adjusting, correcting or optimising the spray of charged droplets. For example, after adjusting the spray of charged droplets, the co-ordinates of the spray spot centre may be determined and used to align the spray spot analysis point to an optical image of the sample or to the sampling stage, sample slide and/or sample.

Various methods of observing the spray spot on a surface will now be described in more detail below.

As illustrated, e.g. in FIGS. 4A-C and FIG. 5, the detector or sensor 403,503 may comprise a pixelated detector comprising an array of pixels. Each pixel of the detector may be arranged to detect, sense or determine the presence of, absence of and/or an intensity of the spray of charged droplets at the pixel position in question. For example, and as will be described in more detail below, an intensity of the charge of the spray of charged droplets may be detected at each of the pixel positions. The plurality of pixels may be used to detect, sense or determine the one or more parameters or properties of the spray of charged droplets.

According to various embodiments, the spray of charged droplets may be directed onto a surface of the detector or sensor such that the detector or sensor detects, senses or determines the one or more parameters or properties of the spray of charged droplets emitted by the first ion source. For example, the spray of charged droplets may be directed onto a surface of the detector, sensor, measurement region or detector array 203,303,403,503 as described above. The detector or sensor may accordingly be arranged and adapted to detect, sense or determine the one or more parameters or properties of the spray of charged droplets as the spray of charged droplets impacts upon the surface of the detector or sensor.

For example, according to an embodiment a charge sensitive spatial sensor array (i.e. a detector or sensor) may be used to detect the charge on the charged droplets impacting upon a surface of the sensor array. Additionally or alternatively, the charge sensitive sensor array may detect the charge of one more additives added to the spray of charged droplets. Thus the charge sensitive detector or sensor may be arranged to detect, sense or determine the charge on the charged droplets and/or additive, as the charged droplets and/or additive impact upon a surface of the detector or sensor.

According to various embodiments, the detector may comprise a charge coupled device ("CCD"), an electron-multiplying charge coupled device ("CCD"), a conductive detector (e.g. a conductive line array), an inductive detection system, a magnetic detector and/or a capacitive detection system for detecting the charge on the charged droplets.

According to various embodiments, the detector or sensor may comprise an optical detector or sensor. For example, an optical spatial sensor may be used to observe the spray of charged droplets and/or an additive added to the spray of charged droplets.

The spray or additive may be observed directly, e.g. by directing the spray of charged droplets onto a surface of the optical detector or sensor, e.g. the surface of a lens of the detector or sensor. The optical detector or sensor may accordingly be arranged to detect, sense or determine directly the one or more parameters or properties of the spray of charged droplets by causing the spray of charged droplets and/or additive to impact upon the optical detector or sensor.

Alternatively, the spray or additive may be observed indirectly, e.g. by directing the spray of charged droplets onto a surface and observing fluorescence emitted by the surface, the spray of charged droplets and/or one or more additives to the spray of charged droplets. The optical detector or sensor may accordingly be arranged to detect, sense or determine indirectly the one or more parameters or properties of the spray of charged droplets by remotely observing the spray of charged droplets and/or additive without the spray of charged droplets and/or additive impacting upon the optical detector or sensor.

According to various embodiments, the surface fluorescence may be observed from a specialised surface material or coating using a charge coupled device ("CCD") camera, an optical line array, an electron-multiplying charge coupled device ("CCD"), one or more photo diodes, one or more light dependent resistors ("LDRs") and/or a fluorescence detector. The compound or additive may be switched into the spray of charged droplets for at least part of the duration of a measurement.

It will be appreciated that the electro-spray droplets (i.e. spray of charged droplets) may be detected, sensed or determined by an optical method (including direct imaging and observational imaging), an electrical method (including charge, capacitance, magnetism, induction), a chemical method (including additives, fluorescent compounds in the spray and compounds deposited e.g. onto the slide) and/or other approaches. Optical images may be processed to determine the one or more parameters or properties of the spray of charged droplets (e.g. spray spot size) from a snapshot.

Although the various embodiments have been described above with reference to directing the spray of charged droplets in a fixed manner such that the one or more parameters or properties of the spray of charged droplets are determined by the detector or sensor, according to other various embodiments the spray of charged droplets may be moved relative to or scanned across the detector or sensor in order to detect, sense or determine the one or more parameters or properties of the spray of charged droplets. It will be appreciated that either only the spray, only the detector or sensor, or both the spray and the detector or sensor may be moved such that the spray and the detector or sensor move relative to each other.

Furthermore, although the various embodiments have been described above with reference to a two-dimensional detector or array, according to other various embodiments, the detector or sensor may comprise one or more line detectors. The spray of charged droplets may be moved relative to or scanned across a two-dimensional detector or a line detector. The line detector may comprise, for example, a series of electrodes, charge coupled devices ("CCD"), photo diodes and/or light dependent resistors ("LDRs").

Figures 6A, 6B, 6C:
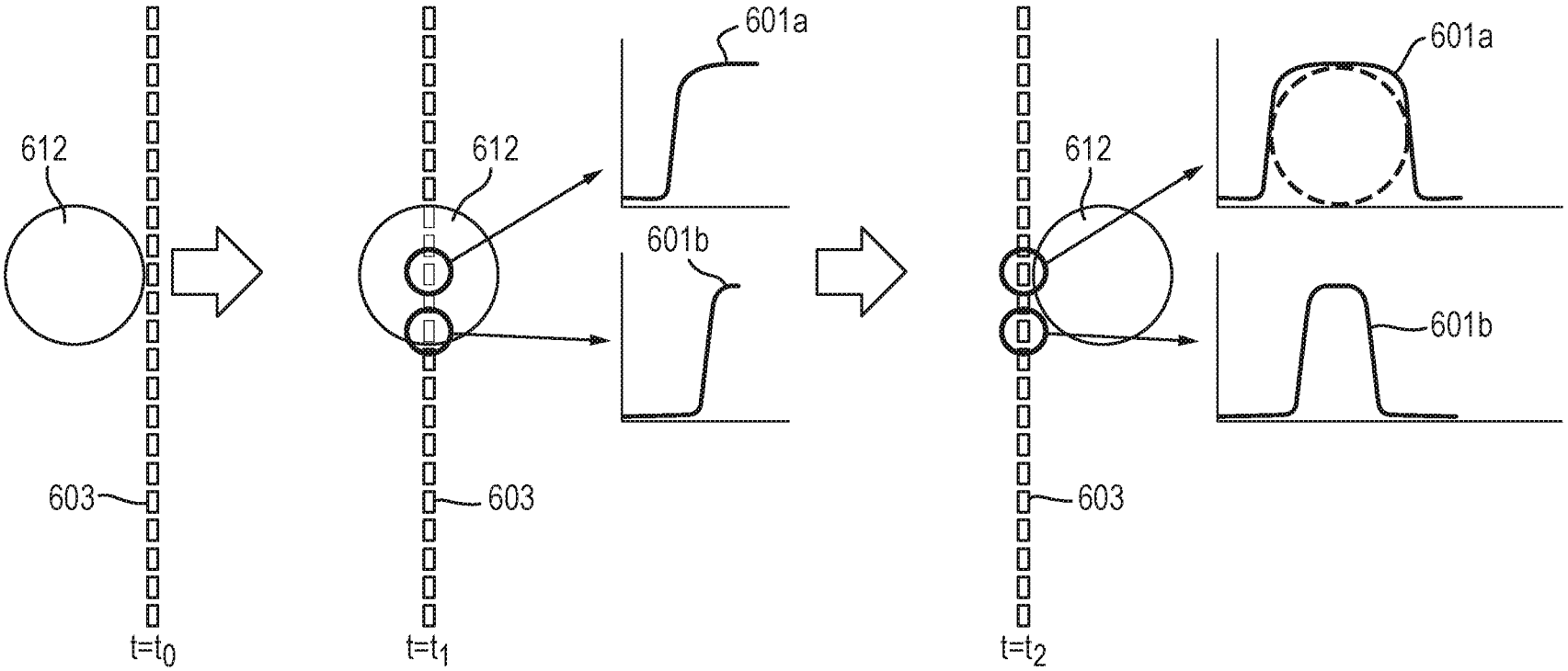
FIG. 6A shows a line detector method of spot size measurement at an initial time $t_0$.
FIG. 6B shows the line detector method of spot size measurement at an intermediate time $t_1$.
FIG. 6C shows the line detector method of spot size measurement at later time $t_2$.

For example, FIGS. 6A-C show an embodiment wherein the spray of charged droplets may be moved relative to or scanned across a line detector in order to determine, e.g. a profile, a position and a spot size of the spray of charged droplets. A current density profile of the spray of charged droplets may also be determined.

As shown in FIGS. 6A-C, one or more profiles 601*a*,601*b* may be determined at one or more positions spaced along the length of a line detector 603, by moving a spray spot 612 relative to the line detector 603 in a direction that has a component that is substantially perpendicular to the direction along the (axial) length of the line detector 603. It will be appreciated, however, that the line detector 603 need not form a straight line, and may for example, be non-linear or curved.

As shown in FIG. 6A, at an initial time $t=t_0$, the spray spot 612 may be directed to one side of line detector 603 and may be moved relatively towards the line detector 603. The spray spot 612 may then begin to move across the line detector 603 and one or more profiles 601*a*,601*b* of the spray spot 612 may be detected, sensed or determined by the line detector 603. Thus, as shown in FIG. 6B, at an intermediate time $t=t_1$ ($>t_0$), the spray spot 612 may be directed across the line detector 603 and profiles 601*a*,601*b* may be partially determined. At a later time $t=t_2$ ($>t_1$), the entirety of spray spot 612 may have moved relatively across the line detector 603 and full profiles 601*a*,601*b* may be determined.

The determined one or more profiles of the spray of charged droplets may then be used to determine, e.g. a spot size, shape and/or position (i.e. one or more parameters or properties) of the spray of charged droplets. The determined one or more first parameters or properties of the spray of charged droplets may be used to adjust, correct or optimise one or more second parameters or properties (e.g. spot size, shape and/or position) of the spray of charged droplets (e.g. as described above, for example, in connection with the embodiment described above with reference to FIG. 5).

According to an alternative embodiment, the detector or sensor may comprise two or more spaced apart markers or detectors. The two or more spaced apart markers or detectors may be provided at known and/or fixed positions relative to the sample, sample slide and/or sampling stage and may be deposited onto, provided on or integrated with a surface of the sample slide, sampling stage or another surface.

For example, according to an embodiment the detector or sensor may comprise two or more spaced apart chemical or other markers (e.g. a series of geometric shapes) that may be deposited onto or provided on a surface of a sample slide, sampling stage or another surface that is provided at a fixed and/or known position relative to the sample, sample slide and/or sampling stage. The chemical or other markers may comprise one or more chemicals that may readily desorb and ionise from the surface when illuminated by a spray of charged droplets emitted from a first ion source, e.g. a desorption electrospray ionisation ("DESI) sprayer. Desorbed and ionised chemical or other markers may be detected, e.g. by an ion mobility analyser or spectrometer and/or by a mass spectrometer or mass analyser.

According to another embodiment, the detector or sensor may comprise two or more spaced apart optical or charge sensitive detectors (e.g. as described above) for directly or indirectly detecting the spray of charged droplets emitted from the first ion source.

Each spaced apart marker or detector may form a line or other shape. It will be appreciated that each spaced apart marker or detector line need not form a straight line and may, for example, be non-linear or curved.

The spaced apart markers or detectors may be used to determine the one or more parameters or properties of the spray of charged droplets. Calibration of the sampling stage, sampling slide and/or sample to the sprayer central point and determination of the spray spot size using spaced apart markers or detectors will now be described in more detail below with reference to FIG. 7.

Figure 7:
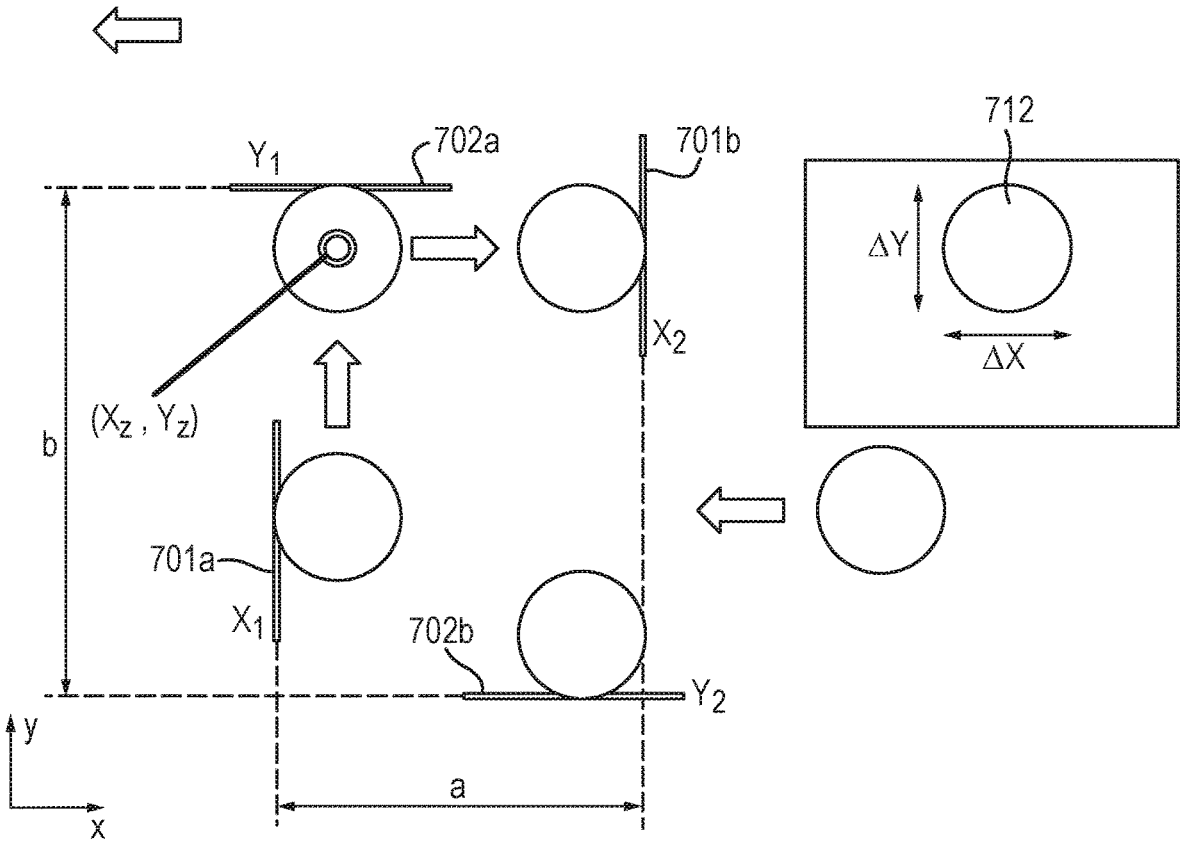
FIG. 7 shows an alternative embodiment for calibrating the stage-spray home position and measuring the spot size.

FIG. 7 schematically illustrates a sprayer (i.e. a first ion source) having a spray spot 712 with a size of ΔY in a Y direction and ΔX in an X direction. A first pair of spaced apart marker or detector lines 701*a*,701*b* may be deposited onto or provided on a sample slide or sampling stage at positions $X_1$ and $X_2$ which are spaced apart in the X direction by a distance of a. A second pair of spaced apart marker or detector lines 702*a*,702*b* may be deposited onto or provided on the sample slide or sampling stage at positions $Y_1$ and $Y_2$ which are spaced apart in the Y direction by a distance of b. The sample slide may contain a tissue or other sample.

The sample slide and/or sampling stage may be moved in the X direction until the spray spot meets the spaced apart marker or detector at $X_1$ whereupon the interaction of the spray and spaced apart marker or detector is detected (e.g. by a mass spectrometer detecting desorbed and ionised chemical marker or by direct detection of the spray). The sample slide or sampling stage position corresponding to position $X_1$ may be determined based on the position at which the interaction is detected. Similarly, the sample slide or sampling stage may then be moved in the Y direction until the spray spot meets the spaced apart marker or detector at $Y_1$ and the interaction of the spray and spaced apart marker or detector is detected. The sample slide or sampling stage position corresponding to position $Y_1$ may be determined. This may be repeated in the Y and X directions for spaced apart markers or detectors at $Y_2$ and $X_2$ so that the sample slide or sampling stage positions corresponding to positions $X_1$, $X_2$, $Y_1$ and $Y_2$ may be determined.

A calibration point $X_z$, $Y_z$ and the spray spot dimensions ΔX and ΔY (i.e. one or more parameters or properties of the spray of charged droplets) may then be calculated, e.g. by solving the following equations (which assume left to right is positive X and down to up is positive Y):

$$X_2 = X_1 + a - \Delta X \quad (1)$$

$$Y_2 = Y_1 - b + \Delta Y \quad (2)$$

$$Y_z = Y_1 - \frac{\Delta Y}{2} \quad (3)$$

$$X_z = X_1 + \frac{\Delta X}{2} \quad (4)$$

Various different embodiments relating to methods of analysis, e.g. methods of medical treatment, surgery and diagnosis and non-medical methods, are contemplated. According to some embodiments the methods disclosed above may be performed on in vivo, ex vivo or in vitro tissue sample. The tissue may comprise human or non-human animal or plant tissue. Other embodiments are contemplated wherein the target or sample may comprise biological matter or organic matter (including a plastic). Embodiments are also contemplated wherein the target or sample comprises one or more bacterial colonies or one or more fungal colonies.

Various embodiments are contemplated wherein analyte ions generated by an ambient ionisation ion source are then subjected either to: (i) mass analysis by a mass analyser or filter such as a quadrupole mass analyser or a Time of Flight mass analyser; (ii) ion mobility analysis (IMS) and/or differential ion mobility analysis (DMA) and/or Field Asymmetric Ion Mobility Spectrometry (FAIMS) analysis; and/or (iii) a combination of firstly (or vice versa) ion mobility analysis (IMS) and/or differential ion mobility analysis (DMA) and/or Field Asymmetric Ion Mobility Spectrometry (FAIMS) analysis followed by secondly (or vice versa) mass analysis by a mass analyser or filter such as a quadrupole mass analyser or a Time of Flight mass analyser. Various embodiments also relate to an ion mobility spectrometer and/or mass analyser and a method of ion mobility spectrometry and/or method of mass analysis. Ion mobility analysis may be performed prior to mass to charge ratio analysis or vice versa.

Various references are made in the present application to mass analysis, mass analysers or filters, mass analysing, mass spectrometric data, mass spectrometers and other related terms referring to apparatus and methods for determining the mass or mass to charge of analyte ions. It should be understood that it is equally contemplated that the present invention may extend to ion mobility analysis, ion mobility analysers, ion mobility analysing, ion mobility data, ion mobility spectrometers, ion mobility separators and other related terms referring to apparatus and methods for determining the ion mobility, differential ion mobility, collision cross section or interaction cross section of analyte ions. Furthermore, it should also be understood that embodiments are contemplated wherein analyte ions may be subjected to a combination of both ion mobility analysis and mass analysis i.e. that both (a) the ion mobility, differential ion mobility, collision cross section or interaction cross section of analyte ions together with (b) the mass to charge of analyte ions is determined. Accordingly, hybrid ion mobility-mass spectrometry (IMS-MS) and mass spectrometry-ion mobility (MS-IMS) embodiments are contemplated wherein both the ion mobility and mass to charge ratio of analyte ions generated e.g. by an ambient ionisation ion source are determined. Ion mobility analysis may be performed prior to mass to charge ratio analysis or vice versa. Furthermore, it should be understood that embodiments are contemplated wherein references to mass spectrometric data and databases comprising mass spectrometric data should also be understood as encompassing ion mobility data and differential ion mobility data etc. and databases comprising ion mobility data and differential ion mobility data etc. (either in isolation or in combination with mass spectrometric data).

Various surgical, therapeutic, medical treatment and diagnostic methods are contemplated.

However, other embodiments are contemplated which relate to non-surgical and non-therapeutic methods of mass spectrometry and/or ion mobility spectrometry which are not performed on in vivo tissue. Other related embodiments are contemplated which are performed in an extracorporeal manner such that they are performed outside of the human or animal body.

Further embodiments are contemplated wherein the methods are performed on a non-living human or animal, for example, as part of an autopsy procedure.

Although the present invention has been described with reference to preferred embodiments, it will be understood by those skilled in the art that various changes in form and detail may be made without departing from the scope of the invention as set forth in the accompanying claims.

The invention claimed is:

1. Apparatus comprising:

a first ion source arranged and adapted to emit a spray of charged droplets;

a detector or sensor arranged and adapted automatically to detect, sense or determine one or more first parameters or properties of said spray of charged droplets as said spray of charged droplets impacts upon a surf ace of said detector or sensor; and a control system arranged and adapted to automatically adjust or correct one or more second parameters or properties of said spray of charged droplets based on said one or more first parameters or properties of said spray of charged droplets detected, sensed or determined by said detector or sensor.

2. Apparatus as claimed in claim 1, wherein said first ion source comprises a desorption electrospray ionisation ("DESI") ion source or a desorption electro-flow focusing ("DEFFI") ion source.

3. Apparatus as claimed in claim 1, wherein said one or more first parameters or properties of said spray of charged droplets comprise one or more spatial parameters or properties, one or more calibration parameters or properties, and/or one or more diagnostic parameters or properties of said spray of charged droplets, optionally wherein said one or more first parameters or properties of said spray of charged droplets are selected from the group consisting of: (i) one or more parameters related to a geometry, profile, cross-sectional profile, area, cross-sectional area, shape, symmetry, diameter, circumference, width or spot size of said spray of charged droplets; (ii) one or more parameters related to an absolute position, relative position or offset position of said spray of charged droplets; and (iii) one or more parameters related to a quality, accuracy, variability or reproducibility of said spray of charged droplets.

4. Apparatus as claimed in claim 1, further comprising a sampling stage arranged and adapted to receive a sample, and a device arranged and adapted to direct said spray of charged droplets at said sampling stage and to direct said spray of charged droplets at said detector or sensor so that said detector or sensor detects, senses or determines said one or more first parameters or properties of said spray of charged droplets.

5. Apparatus as claimed in claim 4, wherein said detector or sensor is substantially integrated with or in said sampling stage.

6. Apparatus as claimed in claim 1, wherein said one or more second parameters or properties of said spray of charged droplets comprise one or more spatial parameters or properties, one or more calibration parameters or properties, and/or one or more diagnostic parameters or properties of said spray of charged droplets, optionally wherein said one or more second parameters or properties of said spray of charged droplets are selected from the group consisting of: (i) one or more parameters related to a geometry, profile, cross-sectional profile, area, cross-sectional area, shape, symmetry, diameter, circumference, width or spot size of said spray of charged droplets; (ii) one or more parameters related to an absolute position, relative position or offset position of said spray of charged droplets; and (iii) one or more parameters related to a quality, accuracy, variability or reproducibility of said spray of charged droplets.

7. Apparatus as claimed in claim 1, wherein said one or more second parameters or properties of said spray of charged droplets are adjusted or corrected by adjusting or correcting one or more instrumental parameters, wherein said one or more instrumental parameters are selected from the group consisting of: (i) a solvent flow rate of said first ion source; (ii) a nebulising gas flow rate of said first ion source; (iii) a position of said first ion source; and (iv) a position of said sample and/or sampling stage.

8. Apparatus as claimed in claim 1, wherein said detector or sensor comprises either: (i) a pixelated detector comprising an array of pixels; or (ii) a spatial detector or sensor or a spatial array of detectors or sensors.

9. Apparatus as claimed in claim 1, wherein said detector or sensor further comprises a device arranged and adapted to determine said one or more first parameters or properties of said spray of charged droplets using pattern or shape recognition.

10. Apparatus as claimed in claim 1, wherein said detector or sensor comprises a charge sensitive detector or sensor, wherein optionally said charge sensitive detector or sensor is arranged and adapted to detect, sense or determine a charge on said charged droplets and/or one or more additives added to said spray of charged droplets.

11. Apparatus as claimed in claim 1, wherein said detector or sensor comprises an optical detector or sensor, wherein said optical detector or sensor is arranged and adapted to detect, sense or determine directly said one or more first parameters or properties of said spray of charged droplets by observing said spray of charged droplets and/or one or more additives added to said spray of charged droplets.

12. Apparatus as claimed in claim 1, wherein said control system is further arranged and adapted to move or scan said spray of charged droplets relative to said detector or sensor, wherein said detector or sensor is arranged and adapted to detect, sense or determine one or more profiles of said spray of charged droplets as said spray of charged droplets is moved or scanned relative to said detector or sensor, and wherein said detector or sensor is arranged and adapted to detect, sense or determine said one or more first parameters or properties of said spray of charged droplets based on said one or more profiles of said spray of charged droplets.

13. Apparatus as claimed in claim 1, wherein said detector or sensor comprises either: (i) a two-dimensional detector or sensor; (ii) one or more line detectors; (iii) two or more spaced apart detectors.

14. An ambient ionisation ion source comprising apparatus as claimed in claim 1.

15. A method comprising:

using a first ion source to emit a spray of charged droplets;

using a detector or sensor automatically to detect, sense or determine one or more first parameters or properties of said spray of charged droplets as said spray of charged droplets impacts upon a surface of said detector or sensor; and automatically adjusting, or correcting one or more second parameters or properties of said spray of charged droplets based on said one or more first parameters or properties of said spray of charged droplets.

16. Apparatus as claimed in claim 4, wherein said detector or sensor is provided at a fixed position relative to said sampling stage.

17. Apparatus as claimed in claim 1, wherein said detector or sensor is arranged and adapted automatically to detect, sense or determine a size and shape of said spray of charged droplets; and wherein said control system is arranged and adapted to automatically adjust or correct the size and shape of said spray of charged droplets based on the size and shape of said spray of charged droplets detected, sensed or determined by said detector or sensor.

18. Apparatus as claimed in claim 1, wherein said detector or sensor is arranged and adapted automatically to detect, sense or determine a position of said spray of charged droplets; and wherein said control system is arranged and adapted to calibrate the position of said spray of charged droplets based on the position of said spray of charged droplets detected, sensed or determined by said detector or sensor.

* * * * *